United States Patent [19]

Katsuki et al.

[11] Patent Number: 4,521,931

[45] Date of Patent: Jun. 11, 1985

[54] METHOD FOR THREADING FILAMENTS ON ROLLERS OF OXIDIZING FURNACE AND APPARATUS THEREFOR

[75] Inventors: Kosuke Katsuki; Youiti Nishioka, both of Ehime; Susumu Nomura, Otsu, all of Japan

[73] Assignee: Toray Industries, Inc., Tokyo, Japan

[21] Appl. No.: 558,352

[22] Filed: Dec. 5, 1983

[30] Foreign Application Priority Data

Dec. 7, 1982 [JP] Japan ..... 57-214241

[51] Int. Cl.[3] ..... D06B 3/04

[52] U.S. Cl. ..... 8/149.2; 28/248; 34/52; 68/2; 68/5 E; 264/29.2; 423/447.4; 423/447.6

[58] Field of Search ..... 68/2, 5 D, 5 E; 423/447.1, 447.4, 447.6; 264/29.2; 34/52; 432/45; 28/248, 281; 8/149.2, 149.3

[56] References Cited

U.S. PATENT DOCUMENTS 3,622,140 11/1971 Schwestka et al. ..... 432/45

FOREIGN PATENT DOCUMENTS 52-74026 6/1977 Japan .
54-1811 1/1979 Japan .

*Primary Examiner*—Philip R. Coe
*Attorney, Agent, or Firm*—Birch, Stewart, Kolasch & Birch

[57] ABSTRACT

A method and apparatus for threading acrylic filaments on rollers of an oxidizing furnace, wherein (a) the atmospheric temperature in the furnace is maintained at 180° C. to the oxidizing temperature, (b) the tips of said filaments are fastened to a filament-fastening bar spanning a pair of chains which engage chain wheels provided at both ends of each roller freely rotatable against the roller, (c) the chains are moved, thereby said filament-fastening bar attached to the chains being moved from the entrance to the exit of the furnace and the filaments being threaded on the rollers, and (d) the moving speed of the chains is controlled with progress of heat-treating of the filaments so as to match the behavior of shrinkage and elongation of the filaments.

17 Claims, 10 Drawing Figures

METHOD FOR THREADING FILAMENTS ON ROLLERS OF OXIDIZING FURNACE AND APPARATUS THEREFOR

BACKGROUND OF THE INVENTION

1. Field of the Invention

The present invention relates to a method and apparatus for threading acrylic filaments on rollers of an oxidizing furnace used in the oxidizing stage of the production of carbon fibers from the acrylic filaments.

2. Description of the Prior Art

It is well known to produce carbon fibers from acrylic filaments by submitting the acrylic filaments to an oxidizing treatment and then to a carbonizing treatment. It is also known from Japanese Patent Publication No. SHO 51-27778 or SHO 52-74026 to execute the oxidizing treatment in an oxidizing furnace with multistage rollers. The furnace with multistage rollers, which is a comparatively small furnace providing a relatively long oxidizing zone, is just beginning to be used as an oxidizing furnace for the acrylic filaments. However, this furnace takes a relatively long time for the oxidizing treatment.

In this type of furnace with multistage rollers the filaments have to be threaded in a zigzag manner on a plurality of rollers. In the conventional method of threading filaments on rollers, the filaments were manually threaded successively on a plurality of rollers and the work was extremely bothersome. Another trouble in the conventional method of threading filaments on rollers was that when the temperature of the atmosphere in the furnace was raised to the oxidizing treatment temperature after the filaments were threaded, the filaments were sometimes broken or slackened on account of contraction or expansion and thereby the start of normal operation for oxidizing treatment was hindered.

Meanwhile Japanese Patent Publication No. SHO 54-1811 discloses a method for threading filaments by means of a chain, in which a filament-fastening bar is installed between a pair of chains provided at the both ends of rollers. The filaments are fastened to this bar and when the chains are moved, the filaments are threaded on said rollers.

When this method was applied to the furnace with multistage rollers, acrylic filaments having a specific treating hysteresis suffered heavy contraction in the atmosphere of 180° C. to the oxidizing treatment temperature in the furnace, resulting in a failure of filament-threading by the chains. In light of this experience, it was also tried to employ less contracting lead filaments in the hot atmosphere of the furnace, but this was equally bothersome and could not be employed from the view point of practical application. Nevertheless the merit of threading the filaments in an atmosphere of 180° C. to the oxidizing treatment temperature was fully appreciated, because unlike in the conventional method of threading the filaments at a room temperature and then elevating the furnace temperature for normal operation, breakage of filaments would be reduced and the time taken to elevate the temperature of the atmosphere from a room temperature to the heat-treatment temperature would be drastically cut back, thereby resulting in an increased productivity. Thus the demand for realizing this new threading art has been mounting.

SUMMARY OF THE INVENTION

An object of the present invention is to provide a method and apparatus for threading filaments on rollers of an oxidizing furnace successively in an atmosphere of 180° C. to the oxidizing treatment temperature.

In the method of the present invention which accomplishes the above object, threading of acrylic filaments on rollers of an oxidizing furnace is executed as follows:

(a) The atmospheric temperature in the oxidizing furnace is maintained at 180° C. to the oxidizing temperature.

(b) The tips of the filaments are fastened to a filament-fastening bar spanning a pair of right and left chains which engage chain wheels provided at both ends of each roller freely rotatable against said roller and turn in a zigzag manner around one chain wheel after another from the entrance to the exit of the oxidizing furnace.

(c) Then said chains are moved, thereby the filament-fastening bar is moved one roller after another and the filaments are threaded onto one roller after another successively.

(d) In above threading, the movement of said chains from the entrance to the exit of the furnace is decelerated or accelerated depending on the progress of heat-treating of the filaments.

In the apparatus of the present invention which accomplishes the above object, there are provided a series of first rollers for guiding the acrylic filaments and a series of second rollers which are arranged with a spacing to said first rollers, and there is a furnace embracing the filaments which move in a zigzag manner between said first and second rollers, said furnace serving to maintain the furnace atmospheric temperature at 180° C. to the oxidizing treatment temperature. The apparatus includes:

(a) a pair of chain wheels provided at both ends of each of the rollers freely rotatable against said rollers, (b) a pair of chains which successively engage the chain wheels and turn in a zigzag manner around one chain wheel after another, (c) a chain-drive means to move said chains from the entrance to the exit of the furnace, (d) limit switches located so as to match the shrinkage and elongation behavior of said filaments in the oxidizing furnace, said limit switches acting with progress of said chains, (e) a working rod as a part of said chains which serves to manipulate said limit switches, (f) a filament-fastening bar provided between said paired chains, and (g) a speed control means to adjust the speed of said chains driven by said chain-drive means according to the changing behavior of said filaments, based on a signal issued from said limit switches worked by said working rod.

BRIEF DESCRIPTION OF THE DRAWINGS

These and other objects and advantages of the present invention will become more apparent and more readily appreciated from the following exemplary embodiments of the invention taken in conjunction with the accompanying drawings, of which.

DETAILED DESCRIPTION OF THE PREFERRED EMBODIMENTS

Figure 1:
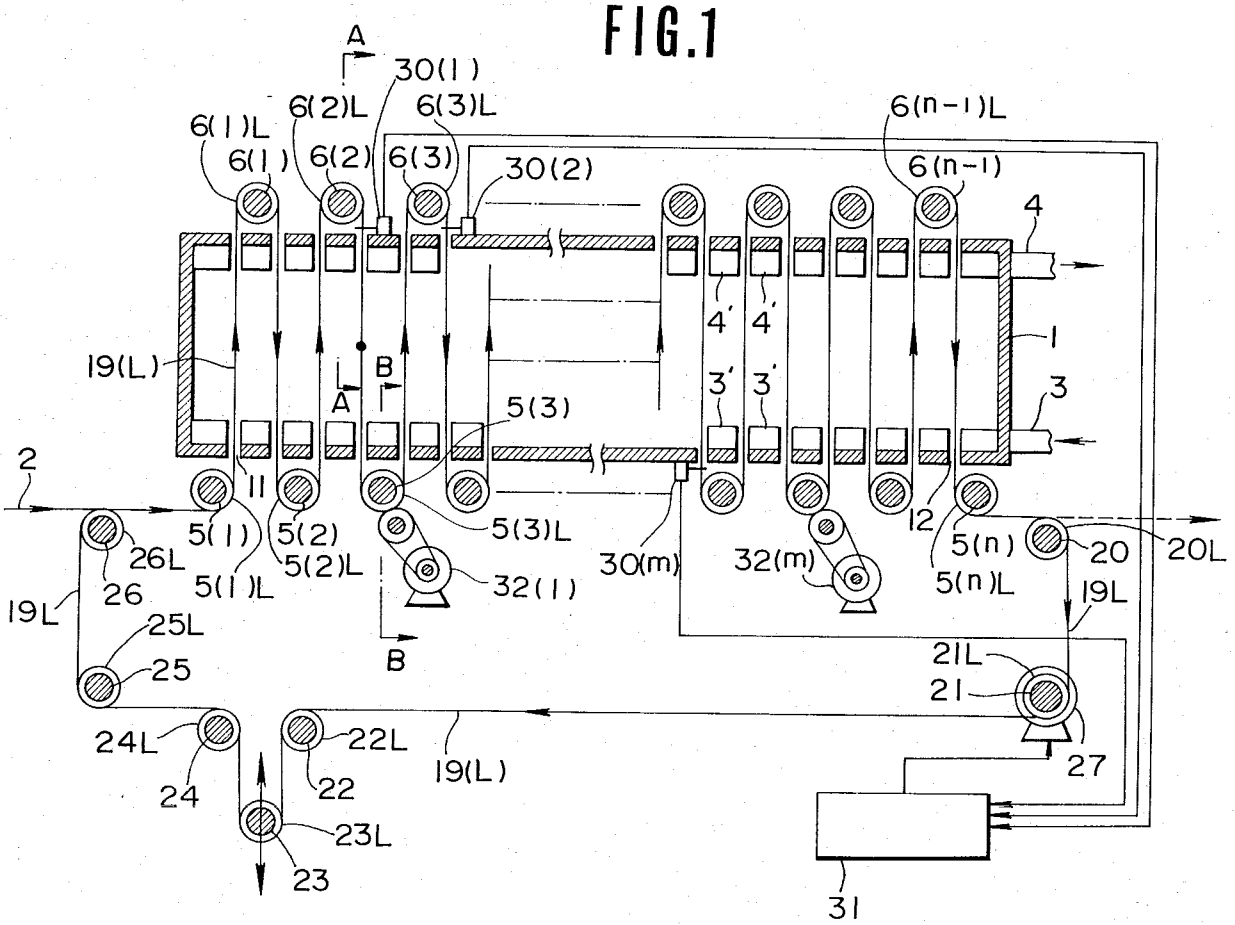
FIG. 1 is a longitudinal sectional view of one example of an apparatus for threading filaments on rollers of an oxidizing furnace according to the present invention.
Figure 2:
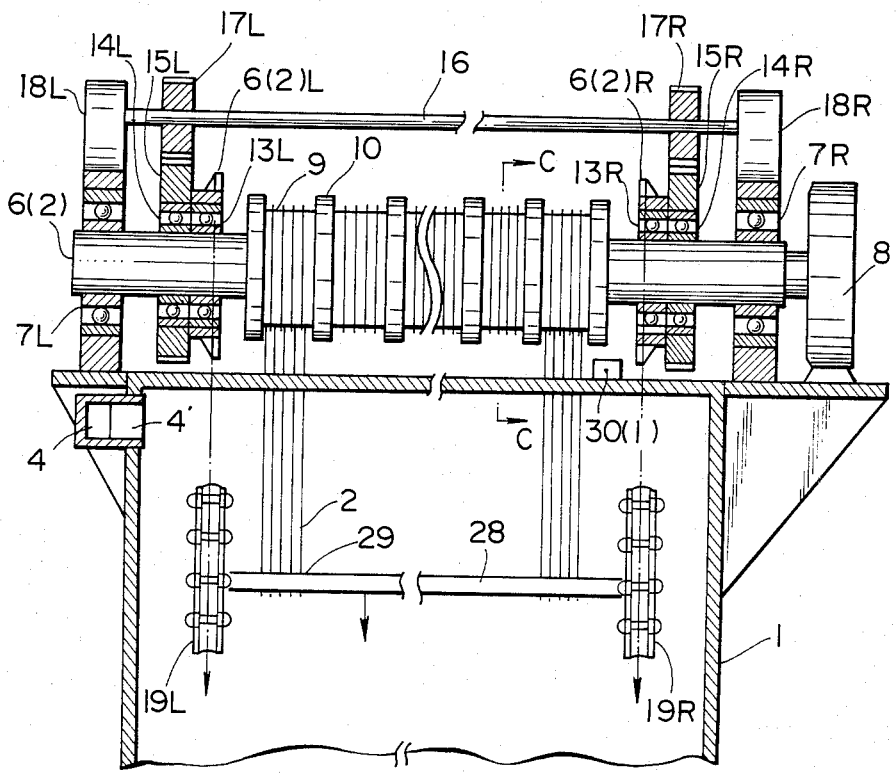
FIG. 2 is a transverse sectional view taken along the line A—A of FIG. 1.
Figure 3:
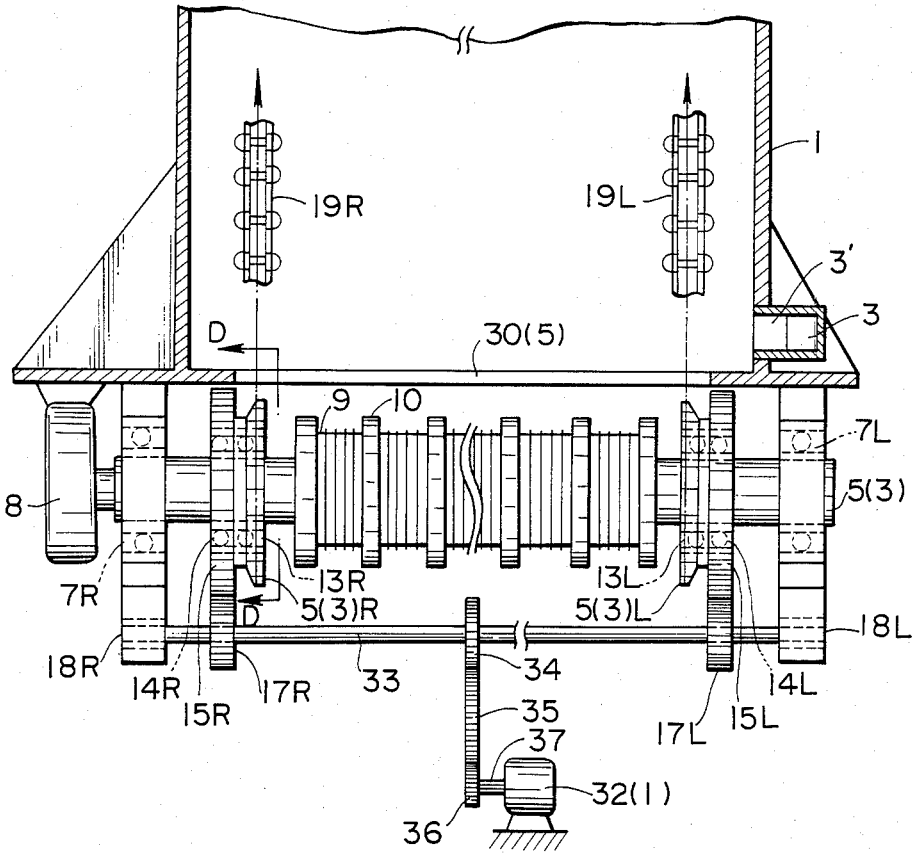
FIG. 3 is a transverse sectional view taken along the line B—B of FIG. 1.

The invention is to be described in detail referring to specific embodiments in conjunction with the attached drawings, in which FIG. 1 is a longitudinal sectional view of one embodiment of the invention, FIG. 2 is a sectional view taken along the line A—A of FIG. 1, and FIG. 3 is a sectional view taken along the line B—B of FIG. 1. In these figures the oxidizing furnace 1 consists of a rectangular body with its width matching the width of a group of filaments 2 to be oxidized and with its length matching the length necessitated for oxidization dependedent on temperature, duration and speed of heat-treatment.

Figure 5:
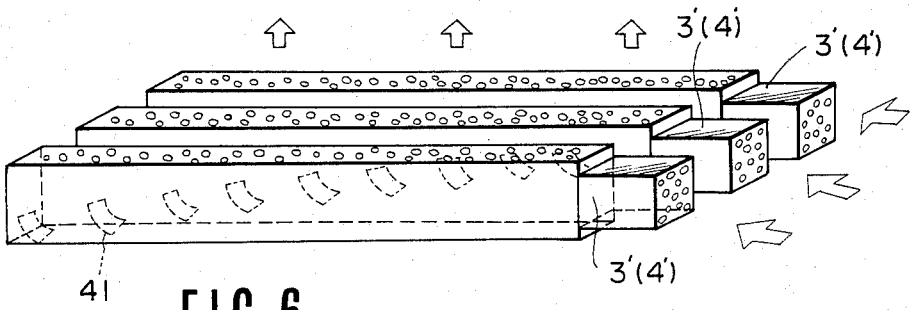
FIG. 5 is a perspective view of gas supply ducts extending into the oxidizing furnace.

At the oxidizing furnace 1 there are provided a gas supply duct 3 to feed a heated-treating gas (usually a heated air) and a gas discharge duct 4 to exhaust the gas used to treat the filaments 2. The gas supply duct 3 communicates to the inside of the furnace 1 through a plurality of openings 3' provided at the side wall of the lower portion of the furnace 1, while said duct 4 communicates to the inside of the furnace 1 through a plurality of openings 4' provided at the side wall of the upper portion of the furnace 1. When the width of the furnace 1 is large, it is desirable, as indicated in FIG. 5, that the ducts 3 and 4 extend into the furnace 1 through the openings 3' and 4' and the gas be fed and exhausted through numerous openings bored on the top and bottom surfaces of said ducts respectively so that the gas can be evenly fed and evenly exhausted in the width direction of the furnace 1. In the ducts 3 there are provided fins 41 for supplying the gas evenly along the length of the ducts 3.

Figure 4:
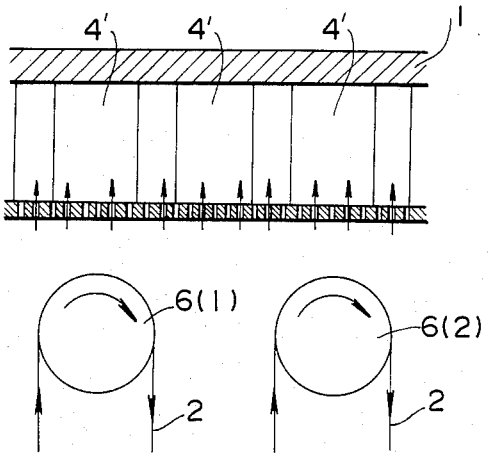
FIG. 4 is a fragmentary sectional view of the vicinity of first rollers of an apparatus wherein said first rollers are located at the top inside of an oxidizing furnace.

At the bottom outside of the furnace 1 there is provided a series of first rollers 5(1)–5(n), while at the top outside of the furnace 1 there is provided a series of second rollers 6(1)–6(n-1). As illustrated in FIG. 4, said second rollers 6(1)–6(n-1) may be installed within the furnace 1.

The construction of each roller and the vicinity thereof are illustrated referring to the roller 6(2) of FIG. 2. The roller 6(2) is rotatably supported at both ends through bearings 7R, 7L fixed to the furnace body. At one end of the roller 6(2) there is a roller-drive motor 8, which is fixed to the furnace body. The middle part of the roller 6(2) has a plurality of annular filament grooves 9 to hold the filaments 2. Such filament grooves 9 are desirably provided in groups of specific number at specific pitch with annular projections 10 provided therebetween. The annular projection 10 serves to protect the filament groove 9 from being damaged when the filament-fastening bar to be described later turns in contact with the roller 6(2). For those of the rollers 5(1)–5(n), 6(1)–6(n-1) which are not necessarily driven to turn positively and have only to follow the movement of the filaments 2, the drive motor 8 may be omitted.

The filaments 2 come into the furnace 1 through the entrance 11, and are threaded in a zigzag manner on the rollers 6(1), 5(2), 6(2), 5(3) . . . 6(n-1) successively, and then leave the furnace 1 through the exit 12 for the next stage.

At both ends of each of the rollers 5(1)–5(n), 6(1)–6(n-1) there are attached the chain wheels 5(1)R, 5(1)L, 6(1)R, 6(1)L . . . 6(n-1)R, 6(n-1)L, 5(n)R, 5(n)L which are free to rotate against the rollers 5(1)–5(n), 6(1)–6(n-1). This condition is to be explained on an example of the roller 6(2). The chain wheel 6(2)R is fitted through the bearing 13R to the roller 6(2), while the chain wheel 6(2)L is fitted through the bearing 13L to the roller 6(2).

Meanwhile, for the purpose of synchronizing the rotations of the chain wheels 6(2)R and 6(2)L, there are provided large gears 15R, 15L attached through the bearings 14R, 14L to the roller 6(2), small gears 17R, 17L meshing with said large gears 15R, 15L and fitted to the synchronizing shaft 16, and bearings 18R, 18L which rotatably support said shaft 16 at both ends thereof.

Synchronization of the chain wheels 6(2)R and 6(2)L is realized by integrating the chain wheel 6(2)R and the large gear 15R by means of a fixing pin (not shown) and integrating the chain wheel 6(2)L and the large gear 15L by means of a fixing pin (not shown).

Such a synchronizing mechanism is not always necessitated between the right and left chain wheels. Only as many synchronizing mechanisms as required for movement of the right and left chains have to be provided between appropriate chain wheels.

A right chain 19R engages in a zigzag manner the right chain wheels 5(1)R, 6(1)R, 5(2)R . . . 6(n-1)R, 5(n)R, while a left chain 19L engages in a zigzag manner the left chain wheels 5(1)L, 6(1)L, 5(2)L . . . 6(n-1)L, 5(n)L. The right chain 19R and the left chain 19L further engage the chain wheels 20R . . . 26R and 20L . . . 26L fitted to both ends of shafts 20, 21, 22, 23, 24, 25, 26 rotatably supported through bearings (not shown), thereby constituting right and left endless chains.

At one end of the shaft 21 there is installed a chain drive motor 27 to rotate said shaft 21. The shaft 23 is supported by an up and down dancing mechanism which adjusts the expansion and contraction of the chains mainly due to the temperature in the furnace 1.

Some right-left pairs of the chain wheels 5(1)R, 5(1)L, 6(1)R, 6(1)L . . . 6(n-1)R, 6(n-1)L, 5(n)R, 5(n)L are positively driven by the motors 32(1)–32(m), i.e., a second chain-drive means in order to positively drive the right and left chains 19R, 19L located in the furnace zone between the entrance 11 and the exit 12. The detailed mechanism will be explained using FIG. 3 on an example of the chain wheels 5(3)R and 5(3)L. The chain wheel 5(3)R is fitted through the bearing 13R to the roller 5(3), while the chain wheel 5(3)L is fitted through the bearing 13L to the roller 5(3). Meanwhile, for the purpose of positively driving the chain wheels 5(3)R and 5(3)L, there are provided the large gears 15R, 15L attached through the bearings 14R, 14L to the roller 5(3), the small gears 17R, 17L meshing with said large gears 15R, 15L and fixed to the rotation-transmitting shaft 33, and the bearings 18R, 18L which rotatably support said transmitting shaft 33 at both ends thereof.

The chain wheel 5(3)R and the large gear 15R are integrated by means of a fixing pin (not shown), while the chain wheel 5(3)L and the large gear 15L are integrated by means of a fixing pin (not shown). At the approximately midpoint of said shaft 33 the chain wheel 34 is positioned which connects an endless chain 35. Said endless chain 35 connects to a chain wheel 36, which is fitted to the drive shaft 37 of the second chain-drive motor 32(1). It should be noted that the mechanism illustrated in FIG. 3 is absolutely the same as the mechanism illustrated in FIG. 2, wherein there is instead of the synchronizing shaft 16 a rotation-transmitting shaft 33, to which is attached the second chain drive system comprising the chain wheel 34, the chain 35, the chain wheel 36, the drive shaft 37 and the second chain-drive motor 32(1).

Between the right and left chains there is installed at least one filament-fastening bar 28, both ends of which are dismountably fitted to the right and left chains 19R, 19L. The filament-fastening bar 28 has filament-fitting holes 29, the pitch of the holes matching the pitch of the grooves 9 provided on the rollers 5(1)–5(n), 6(1)–6(n-1). And the tips of the filaments are fastened to the bar 28 through these holes 29.

Along the zigzag path of the chain 19 there are installed limit switches 30(1), 30(2) . . . 30(m) at one, preferably several spots of the path. The detecting rod of the limit switch is designed such that it automatically works when the filament-fastening bar 28 passes the limit switch. Depending on the application, a device (not shown) may be utilized to manipulate the detecting rod as one part of the chain 19 at a position ahead of the filament-fastening bar 28. The limit switch 30 issues an ON or OFF signal, which goes to the speed control device 31. An electric signal generated in said speed control device 31 then goes to the chain-drive motor 27 and thereby a change in the rotating speed of said motor 27 causes a change in the moving speed of the chain 19.

Figure 6:
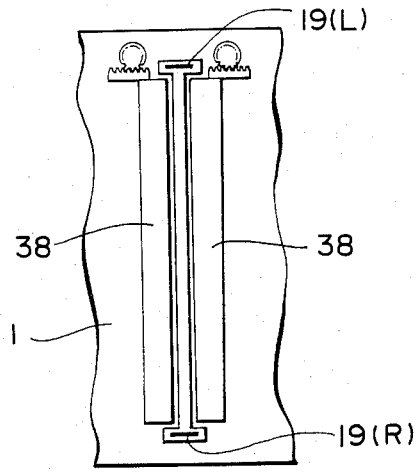
FIG. 6 is a plan view of the vicinity of slits.
Figure 7:
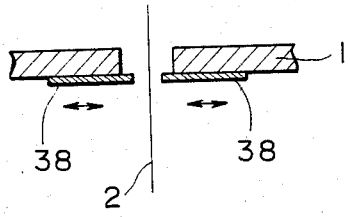
FIG. 7 is a sectional view of the vicinity of the slits.

As illustrated in FIGS. 6 and 7, at the entrance and exit of the furnace 1 which pass the filament 2 and the chain 19 there are provided slits with an appropriate width to minimize the escape of the hot gas out of the furnace 1. Preferably there are provided slidable shutters 38 which adjust the slit width such that when the filament-fastening bar 28 thicker than the filament 2 passes, the slit can be enlarged and after it passes, the slit can be narrowed to the extent of barely passing the filament 2.

Filament-threading in the furnace 1 is executed as follows.

The atmospheric temperature in the furnace 1 is maintained at 180° C. to the oxidizing treatment temperature (usually 200–280° C.).

The tips of a specific number of filaments 2 are passed through the corresponding filament-fitting holes 29 of the filament-fastening bar 28. The filament-fastening bar 28 is dismountably attached to the right and left chains 19R, 19L at a position a little past the chain wheels 26R, 26L. After the attaching, the first chain-drive motor 27 is switched on and the chains 19R, 19L begin an endless movement.

Figure 8:
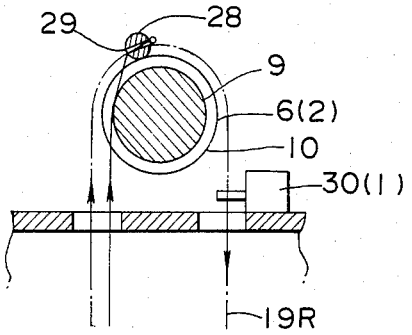
FIG. 8 is a sectional view of the vicinity of a filament-fastening bar.

As the chains 19R, 19L move on, said bar 28 entraining the filament 2 moves to the chain wheels 5(1)R, 5(1)L, to the chain wheels 6(1)R, 6(1)L, to the chain wheels 5(2)R, 5(2)L . . . to the chain wheels 6(n-1)R, 6(n-1)L and then to the chain wheels 5(n)R, 5(n)L. And every time the filament-fastening bar 28 turns around the rollers 5(1), 6(1), 5(2) . . . 6(n-1), 5(n), the filaments entrained by said bar 28 fit into the filament grooves 9 provided in the rollers 5(1), 6(1), 5(2) . . . 6(n-1), 5(n). The process is shown in FIG. 8 on an example of the roller 6(2).

In this process of filament-threading, the filaments 2 passing through the furnace 1 shrink or elongate depending on the temperature and time. The shrinkage and elongation of the filament 2 along its path are grasped in advance through observation or theoretical calculation and based on the results, the limit switches 30 are arranged from the entrance to the exit of the furnace, so that passage of the filament-fastening bar 28 can be detected by the switches 30. In accordance with the signal of detection the speed control device 31 can adjust the speed of the chain drive motor 27 and thereby adjust the speed of said bar 28, thus preventing a breaking or a slackening of the filament 2.

Figure 10:
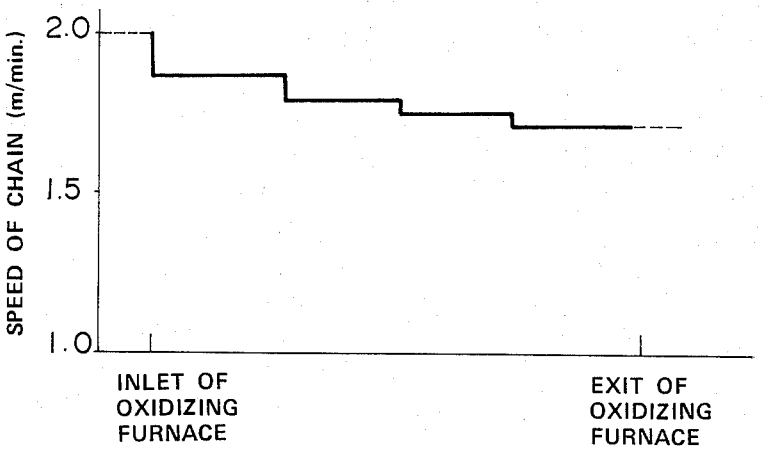
FIG. 10 is a graph showing the variance of the chain speed in the oxidizing furnace.

FIG. 10 illustrates the change in the speed of the filament-fastening bar 28 along the path of the filaments from the entrance 11 to the exit 12 of the furnace.

Instead of providing the limit switch 30, it may be so designed that the speed control device 31 can be operated according to a passage program of the filament-fastening bar 28.

Now the filament-fastening bar 28 reaching the chain wheels 20R, 20L disengages itself from the chain, to be ready for the next stage. Meanwhile, after the filament-threading has been finished, the rollers 5(1), 6(1), 5(2) . . . 6(n-1), 5(n) are, if necessary, stepped up to a specified speed for a normal cycle of oxidizing treatment. In the normal cycle of oxidizing treatment, the rotation of the chain 19 is stopped.

Before starting the filament-threading under high temperature, the number of rotations for each of the rollers 5(1), 6(1), 5(2) . . . 6(n-1), 5(n) is selected depending on the passing speed of the filaments at respective positions, considering the behavior of the filaments to elongate or shrink, so that no breaking nor slackening of the filaments develops between the rollers.

Figure 9:
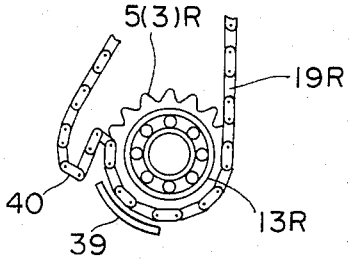
FIG. 9 is an elevational view of the vicinity of a chain wheel.

To stop the movement of the chains 19R, 19L, the first chain-drive motor 27 is cut off, then the second chain drive motor 32(m), and so on from downstream to upstream. Thus a slack of chain is deliberately developed in the vicinity of all or some of the chain wheels 5(1) . . . 5(n) installed under the furnace 1. In this manner, a failure of the chain or the chain wheel due to contraction when the temperature in the furnace 1 happens to drop suddenly in an accident can be averted. The slackened state of the chain is illustrated in FIG. 9 on an example of the chain wheels 5(3)R, 5(3)L. In FIG. 9, a chain slack 40 is formed near the chain wheels 5(3)R, 5(3)L after the chains 19R, 19L are stopped. When said slack 40 is large, the chains 19R, 19L are likely to disengage themselves from the chain wheels 5(3)R, 5(3)L. Therefore, guides 39 for preventing the disengage are arranged along the chain wheels at the lower half or whole part of the chain wheels 5(3)R, 5(3)L with enough spacings to be able to pass the chain.

According to the present invention, the shrinkage and elongation behavior of the filament 2 between the filament-fastening bar 28 and the closest roller to the moving bar 28 among the rollers on which the filaments 2 are threaded can be balanced against the moving speed of the filament-fastening bar 28. Accordingly, the movement of the chain 19 which does not make the same behavior of shrinkage and elongation as the behavior of the filament 2 can be so adjusted as not to permit a breaking or a slackening of the filament. Thus the present invention remarkably enhances the probability of successful filament-treading under high temperature, hence ensuring far superior thermal efficiency and productivity of the furnace to the conventional one.

Next an example of testing about the present invention is introduced.

For the purpose of oxidizing acrylic filaments of 3,000 deniers (1.0d×3,000 fil) in a heated air of the oxidizing furnace illustrated in FIG. 1, each of 100 such yarns was fastened through a specific filament-fastening hole to the filament-fastening bar preliminarily attached to a chain and said chain was moved at a speed indicated in FIG. 4. Thus the filaments were threaded on one roller to another of the oxidizing furnace.

In the test, the atmospheric temperature in the furnace was set at 180° C. and the moving speed of the chain was set at a value decided to match the shrinkage and elongation behavior of acrylic filaments of 3,000 deniers (1.0d×3,000 fil) under a tension of 0.1 g/d which had been preliminarily investigated.

The result of the test showed that every filament could be exactly fitted into the groove of the roller with no trouble of a filament breakage or an entanglement with the roller. And after the threading of the filament on the rollers, the atmosphere could be elevated in about 5 hours to the specified temperature (240° C.) and a normal operation with a filament speed of 4.0 m/min. could be started.

Besides, on account of such arrangement that the chain was driven by both the first chain-drive motor and the second chain-drive motor said chain could be a structurally fine one and the width of the slits through which the chain comes into and goes out of the furnace could be made as narrow as possible, with the result that a variation of the furnace temperature, which has to be constant for the purpose of the oxidizing treatment, could be avoided, the energy loss could be prevented, an oxidized filament of uniform quality could be produced with a low energy consumption, and moreover an escape of waste gas into the working environment could be minimized.

Although only preferred embodiments of the present invention have been described in detail, it will be appreciated by those skilled in the art that various modifications and alterations can be made to the particular embodiments shown without materially departing from the novel teachings and advantages of this invention. Accordingly, it is to be understood that all such modifications and alterations are included within the scope of the invention as defined by the following claims.

What is claimed is:

1. A method for threading acrylic filaments on one roller after another of an oxidizing furnace by moving said filaments from the entrance to the exit of said oxidizing furnace, said method comprising:

(a) maintaining an atmospheric temperature in said oxidizing furnace at 180° C. to an oxidizing temperature;

(b) fastening the tips of said filaments to be threaded to a filament-fastening bar spanning a pair of right and left chains which engage chain wheels attached at the both ends of each roller freely rotatable against said roller and turn in a zigzag manner around one chain wheel after another from said entrance to said exit of said oxidizing furnace;

(c) moving, under said atmospheric temperature, said paired chains and said filament-fastening bar attached to said chains from said entrance to said exit of said oxidizing furnace and threading said filaments on the rollers while said filament-fastening bar turns successively around said rollers; and (d) controlling the moving speed of said chains with progress of heat-treating of the filaments so as to match the behavior of shrinkage and elongation of said filaments during the movement of said chains from said entrance to said exit of said oxidizing furnace.

2. A method of claim 1 wherein controlling of the moving speed of said chains is executed by detecting passage of said filament-fastening bar by means of limit switches arranged from said entrance to said exit of said oxidizing furnace and adjusting the speed of a chain drive motor by means of a speed control device in accordance with the signals from said limit switches.

3. A method of claim 1 wherein controlling of the moving speed of said chains is executed by adjusting the speed of a chain-drive motor by means of a speed control device in accordance with a predetermined program of the passage of said filament-fastening bar.

4. A method of claim 1 wherein after threading said filaments on rollers is finished, moving of said chains is stopped and a slack of said chains is developed in the vicinity of said chain wheels installed under said oxidizing furnace.

5. An apparatus for threading acrylic filaments on rollers of an oxidizing furnace wherein there are a series of first rollers and a series of second rollers with a spacing to said first rollers, and on said first rollers and said second rollers are successively threaded said filaments which are partly embraced by said oxidizing furnace maintained at 180° C. to an oxidizing treatment temperature, said apparatus comprising:

(a) a pair of chain wheels provided at the both ends of each of said rollers freely rotatable against said rollers;

(b) a pair of chains which engage successively said chain wheels at the both ends of each of said rollers and turn in a zigzag manner around one roller after another;

(c) a chain-drive means to move said chains from the entrance to the exit of said oxidizing furnace;

(d) limit switches located to match the shrinkage and elongation behavior of said filaments within said oxidizing furnace, said limit switches acting with progress of said chains;

(e) a working rod provided as one part of said chains and serving to manipulate said limit switches;

(f) a filament-fastening bar installed between said paired chains; and (g) a speed control means to adjust the speed of said chains driven by said chain-drive means according to the changing behavior of said filaments, based on signals issued from said limit switches worked by said working rod.

6. An apparatus of claim 5 wherein said first rollers are located at the top outside of said oxidizing furnace and said second rollers are located at the bottom outside of said oxidizing furnace.

7. An apparatus of claim 5 wherein said first rollers are located at the top inside of said oxidizing furnace and said second rollers are located at the bottom outside of said oxidizing furnace.

8. An apparatus of claim 5 wherein said oxidizing furnace has slits through which said filaments and said filament-fastening bar pass and said slits are provided with slidable shutters which adjust the width of said slits such that when said filament-fastening bar passes, said slits are enlarged and after said filament-fastening bar passes, said slits are narrowed to the extent of barely passing said filaments.

9. An apparatus of claim 5 wherein a hot gas is supplied at the bottom of said oxidizing furnace and exhausted at the top of said oxidizing furnace.

10. An apparatus of claim 5 wherein gas supply ducts are provided and extended into said oxidizing furnace through openings at the side wall of said oxidizing furnace and gas discharge ducts are provided and extended into said oxidizing furnace through openings at said side wall of said oxidizing furnace.

11. An apparatus of claim 5 wherein the middle part of each of said rollers has a plurality of annular filament grooves to hold said filaments.

12. An apparatus of claim 11 wherein said filament grooves are provided in groups with annular projections provided therebetween.

13. An apparatus of claim 5 wherein roller-drive motors are provided for some of said rollers and the roller-drive motor is omitted for those of said rollers which are not necessarily driven to turn positively and have only to follow the movement of said filaments.

14. An apparatus of claim 5 wherein said paired chain wheels provided at the both ends of each of said rollers are synchronized in rotation by means of a synchronizing shaft.

15. An apparatus of claim 5 wherein one of the shafts to which said chain wheels are fitted is supported by an up and down dancing mechanism which adjusts expansion and contraction of said chains mainly due to the atmospheric temperature in said oxidizing furnace.

16. An apparatus of claim 5 wherein some of said paired chain wheels located in the furnace zone between said entrance to said exit of said oxidizing furnace are positively driven by second chain-drive motors.

17. An apparatus of claim 5 wherein guides for preventing said chains from disengaging from said chain wheels are arranged along said chain wheels with spacings to be able to pass said chains.

* * * * *